United States Patent [19]

Williams

[11] 4,267,889

[45] May 19, 1981

[54] EXPLOSION SUPPRESSION SYSTEM FOR FIRE OR EXPLOSION SUSCEPTIBLE ENCLOSURE

[76] Inventor: Robert M. Williams, 16 La Hacienda, Ladue, Mo. 63124

[21] Appl. No.: 33,433

[22] Filed: Apr. 26, 1979

Related U.S. Application Data

[63] Continuation-in-part of Ser. No. 973,679, Dec. 27, 1978, abandoned.

[51] Int. Cl.[3] ..... A62C 37/18

[52] U.S. Cl. ..... 169/61; 340/506

[58] Field of Search ..... 169/61, 60, 66, 68, 169/20, 19, 7, 8, 9, 56, 16; 340/506, 509, 516, 514, 527

[56] References Cited

U.S. PATENT DOCUMENTS

| | | | |
|---|---|---|---|
| 2,988,151 | 6/1961 | Biro | 169/9 |
| 3,139,143 | 6/1964 | Renda | 169/19 |
| 3,825,766 | 7/1974 | Connor et al. | 169/61 |
| 3,912,015 | 10/1975 | Garbee et al. | 169/61 |
| 3,949,812 | 4/1976 | Hay | 169/20 |
| 3,965,988 | 6/1976 | Wesson et al. | 169/9 |
| 3,993,138 | 11/1976 | Stevens et al. | 169/61 |
| 4,101,887 | 7/1978 | Osborne | 169/60 |

*Primary Examiner*—Robert J. Spar
*Assistant Examiner*—Kenneth Noland
*Attorney, Agent, or Firm*—Gravely, Lieder & Woodruff

[57] ABSTRACT

A system for sensing and acting to suppress flame conditions as well as an explosion associated with a flame front in an enclosure which is susceptible to fire and explosion condition, such as trash shredders, grain elevators, and enclosed areas where oxygen and combustible material may be present in the necessary proportions to feed a fire of such rapid propagation as to result in explosive proportions resulting in damage to the structure forming the enclosure. The system comprises devices distributed about the enclosing structure to sense a flame as well as a sudden rise in pressure and set off a fire and explosion suppressing system which operates to flood the enclosed area with an agent capable of quenching the flame causing the pressure rise, and programmable monitoring control circuits for operating the system and all of its components during the time when a pressure rise signals the development of an explosion, and following the suppression of an explosion.

19 Claims, 5 Drawing Figures

EXPLOSION SUPPRESSION SYSTEM FOR FIRE OR EXPLOSION SUSCEPTIBLE ENCLOSURE

This application is a continuation-in-part of my application Ser. No. 973,679, filed Dec. 27, 1978 now abandoned.

BACKGROUND OF THE INVENTION

It is well recognized that a dust laden atmosphere in a closed area is a prime condition for a destructive explosion if a spark is struck in the area. Numerous destructive explosions occure in grain elevators because the conditions are just right. Another prime enclosure for destructive explosion events is the grinding or shredding chamber of mills, where trash is shredded by rapidly rotating hammers which generate a high level of sparks.

It is known that in trash collecting and disposal operations, items like paint thinner containers, ether containing bottles, aerosol cans and other containers charged with hydro-carbons are picked up with combustible components. When these collectibles are thrown into a shredder or grinder for reduction by hammers, there is a constant sparking condition. When the conditions are correct an explosion can be created by some component catching fire to act as the detonator for an explosion. Thus, an industrial explosion is set off by rapid propagation of the flame front.

It is known that an industrial explosion, whether it is in a grain elevator, a trash shredder, or other place, is preceeded by rapid pressure increase measured in thousandths of a second before the pressure created by the fire reaches damaging proportions. It is within this very short time period that something needs to be done to quench the fire and flame propagation. The well known Fenwal explosion suppression system was developed to detect pressure rise and release a fire quenching agent into the area where the fire exists. Fenwal is the registered mark of Fenwal Incorporated Division of Walter Kidde & Co., of Ashland, Mass.

The components of substantially all of the Fenwal systems include containers for the suppressing agent which must be maintained under pressure. The containers are provided with blow out rupture discs which release the agent. Since the system is under substantial pressure for rapid delivery of the flame quenching agent, the rupture discs pieces can act as shrapnel and inflict damage to nearby persons. Also the containers are sufficiently heavy to require hoisting equipment for their installation and removal, and superstructure is required to allow persons to reach the sites of the containers. In addition, after an explosive condition has been sensed and the agent bromochloromethane released, it requires a considerable period of time (measured in days) for service people to reach the scene and recharge the system before giving approval for resumption of operations. All of the above is extremely expensive and requires the operation to be shut down. Also, when resetting the system components, the explosive "squibs" used to rupture the discs are dangerous and require the installation of persons trained in the handling thereof.

BRIEF SUMMARY OF THE INVENTION

The present invention relates to a system for suppressing explosion or fires in enclosures where such conditions are apt to exist, and for recharging of the system.

The system for suppressing fire and explosion is operative in a period of time before damage can take place which means that the flame which has started the rapid pressure rise leading to an explosion must be quenched within a time span that is measured in milliseconds. The operative components must be capable of responding in that time span so that a flame quenching agent can be released at the flame location and surrounding area to quench the flame and arrest the pressure rise before it can do damage to the structure forming the enclosure. The type of structure the present system is capable of protecting can include trash shredders, grain elevators, bag house, wood turning mills, petrochemical plants, and many types of industrial operations where the contents of the atmosphere is presented to flame starting static sparks and sparks generated by other means.

A good example of the present invention may involve protecting a trash shredder where ignitable substances are present during the shredding of paint thinner cans or aerosol containers, and the shredding necessarily is accompanied by constant showers of sparks from the hammers striking metallics, stones and such items. The protection of the shredder is accomplished by the placement of several pressurized containers of a flame quenching agent connected to the shredder enclosure through a high speed valve that is opened upon a sensed flame front or a pressure rise that experience has shown is the forerunner of an explosion. The flame front can be detected by an infrared sensor, but if the detector happens to be blocked by material, the pressure sensor acts as a backup means. The containers are connected into a system which includes a replenishing supply of bromochloromethane agent, and a replenishing supply of an inert pressurizing medium, such as nitrogen, for driving the agent at high speed into the flame area. Furthermore, the system is provided with a programmable control having a group of circuits containing system functions which are able to monitor the important aspect of the shredder protective system from a remote location. The control system can be set up to oversee the operation of the shredder installation and provide periodic checks on the conditions which must be constantly operative to provide the desired protection for what is an expensive installation.

BRIEF DESCRIPTION OF THE DRAWINGS

The present invention has been disclosed in connection with trash shredding means, wherein.

DESCRIPTION OF THE EMBODIMENT

Figure 1:
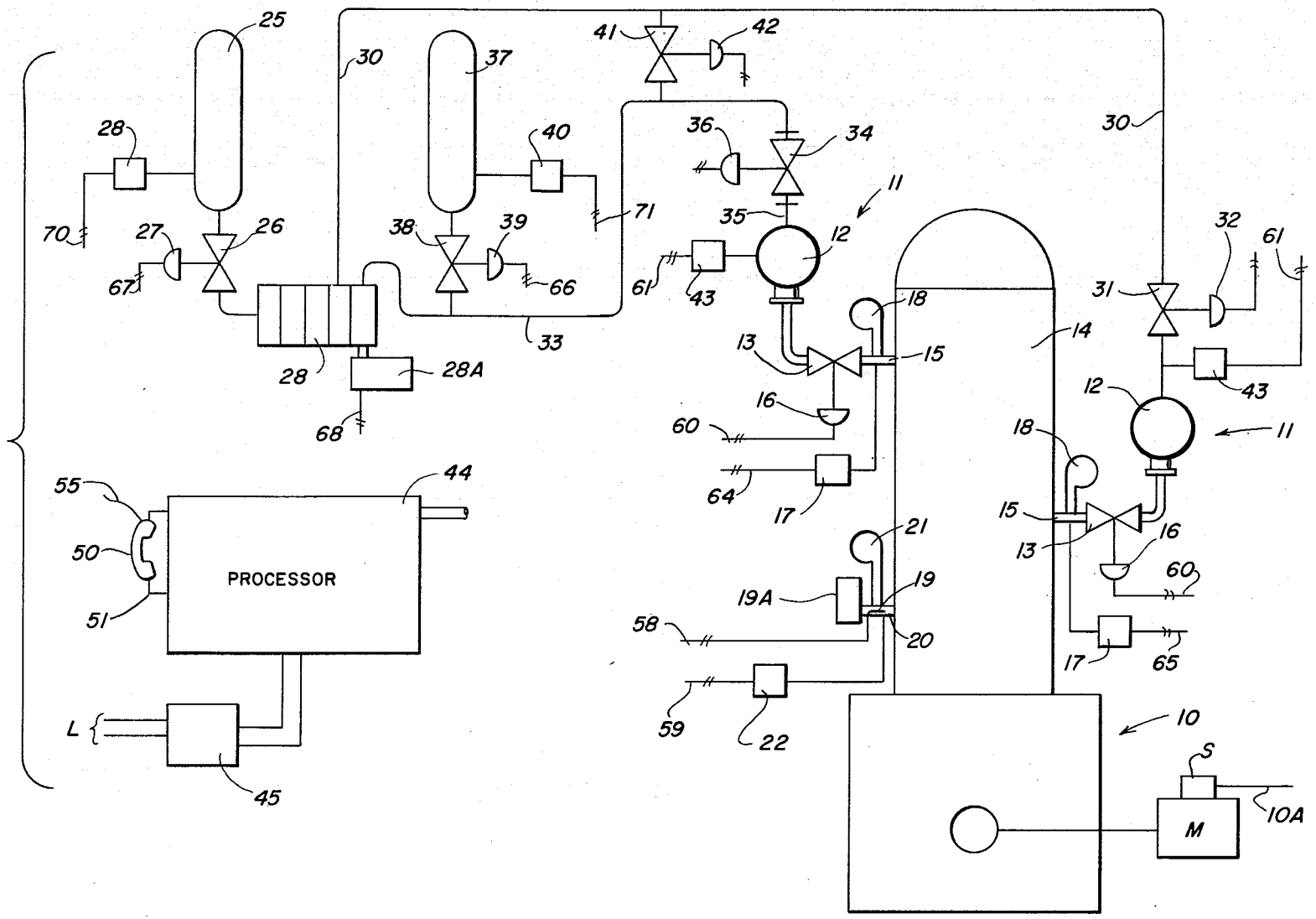
FIG. 1 is a general diagram illustrating the fire and explosion suppression system associated with a shredder.

An embodiment of the present invention is shown in FIG. 1 in connection with its utility with a material shredder 10 which is designed to grind waste material of all kinds, including material that spark when hit by the rapidly rotating hammers. The shredder 10 may be of the character shown in Williams U.S. Pat. No. 3,981,454 issued Sept. 21, 1976, or as shown in Williams U.S. Pat. No. 3,806,048 issued Apr. 23, 1974, or as shown in Williams U.S. Pat. No. 3,667,694 issued June 6, 1972. These examples are cited by way of illustrations and are not to be considered as imposing restrictions on the apparatus which is to be the subject of explosion and fire suppression.

The problem which this invention overcomes is not only to be able to detect a flame front, but to anticipate the possibility of an explosion and react to suppress that event before it can generate damage, to be able to monitor the safety means quickly and from a remote location. A further problem which this invention overcomes is to avoid as much as possible the need for people to be exposed to hazards in and about the shredder installation during a period when the fire and explosion suppressing system is being rehabilitated after being set off.

In FIG. 1 the shredder 10 is provided with a plurality (two being shown) of explosion suppression units 11, each of which includes a pressure vessel 12 connected through a high speed valve 13 to the interior of the material feed stack 14 of the shredder 10 by conduit 15. The high speed valve 13, a commercially available solenoid valve Series 905-14 of Alco Controls, is self closing by resilient means, and is opened by solenoid motor 16. The conduit 15 is monitored by a flow switch 17 which is readily available commercially and is adapted to respond to a lack of air flow in conduit 15 caused by a blower 18 connected into the conduit 15 for a purpose of creating the flow necessary for proving that the conduit 15 is not blocked. The two units 11 are disposed in different locations to be ready to deliver a suppression agent contained under pressure in the pressure vessels 12. The agent may be bromochloromethane or an equivalent agent in liquid form which on release is shot into the closed space at substantial velocity.

The key to the operation of the release of the suppression agent from the vessels 12 is the presence of a flame front detector 19 which can be anyone of the available infrared sensors. In this installation the sensor 19 is employed to work in conjunction with a commercially known type of pressure rise detector device 19A connected by a conduit 20 to the area in the shredder 10 where the flame front or the pressure rise preceeding an explosion is most likely to have its origin. The flame front detector 19 is mounted adjacent the conduit 20 where it can see the interior of the mill 10 without obstructing the conduit. The conduit 20 is tested for obstruction, other than the detector 19, by a blower 21 having its outlet connected into the conduit 20. A pressure flow switch 22, similar to switch 17, is connected to the conduit 20 to respond to a lack of air flow which would indicate an obstruction to the flow of air through conduit 20 from the blower 21. The conduit 20 must be substantially free of obstruction for the proper operation of the infrared sensor 19 and pressure detector 19A.

In studies done on explosion reactions, it is recognized that the pressure wave associated with a fire or flame front in an enclosed space travels faster than the flame propagation. Thus, in the event that the view of sensor 19 is momentarily blocked, the system will still be protected by detection of a rise in pressure only slightly above a normal pressure level. In either case it is possible to release a flame extinguishing agent, such as bromochloromethane which serves to check the pressure rise to a destructive level by snuffing out the flame or by preventing the propagation of the flame into the surrounding areas.

The most frequently used explosion suppression system involves pressurized containers of a suppression agent having a blow-out disc that is ruptured by an explosive cap called a squib that is set off by a pressure sensitive trigger upon a pressure rise of approximately one half pound per square inch. The recharging of the containers requires the handling of the agent, setting a new disc and its explosive rupturing squib in place, pressurizing the assembly, and reconnecting the current lead which ignites the squib after the containers have been replaced in operative positions. Since this activity must be done manually there is some danger of accidentally blowing the disc which will scatter its parts like shrapnel. Also, in these prior systems the pressurized containers must be removed from their operating locations for recharging, and then be returned, all of which requires the use of personnel to disconnect and connect the containers and the use of hoist equipment to move the containers. While all of these steps are being followed, the system must be shut down, and only after the safety components have been reinstalled and all piping and electrical connections check can the system be put back in operation.

Figure 2:
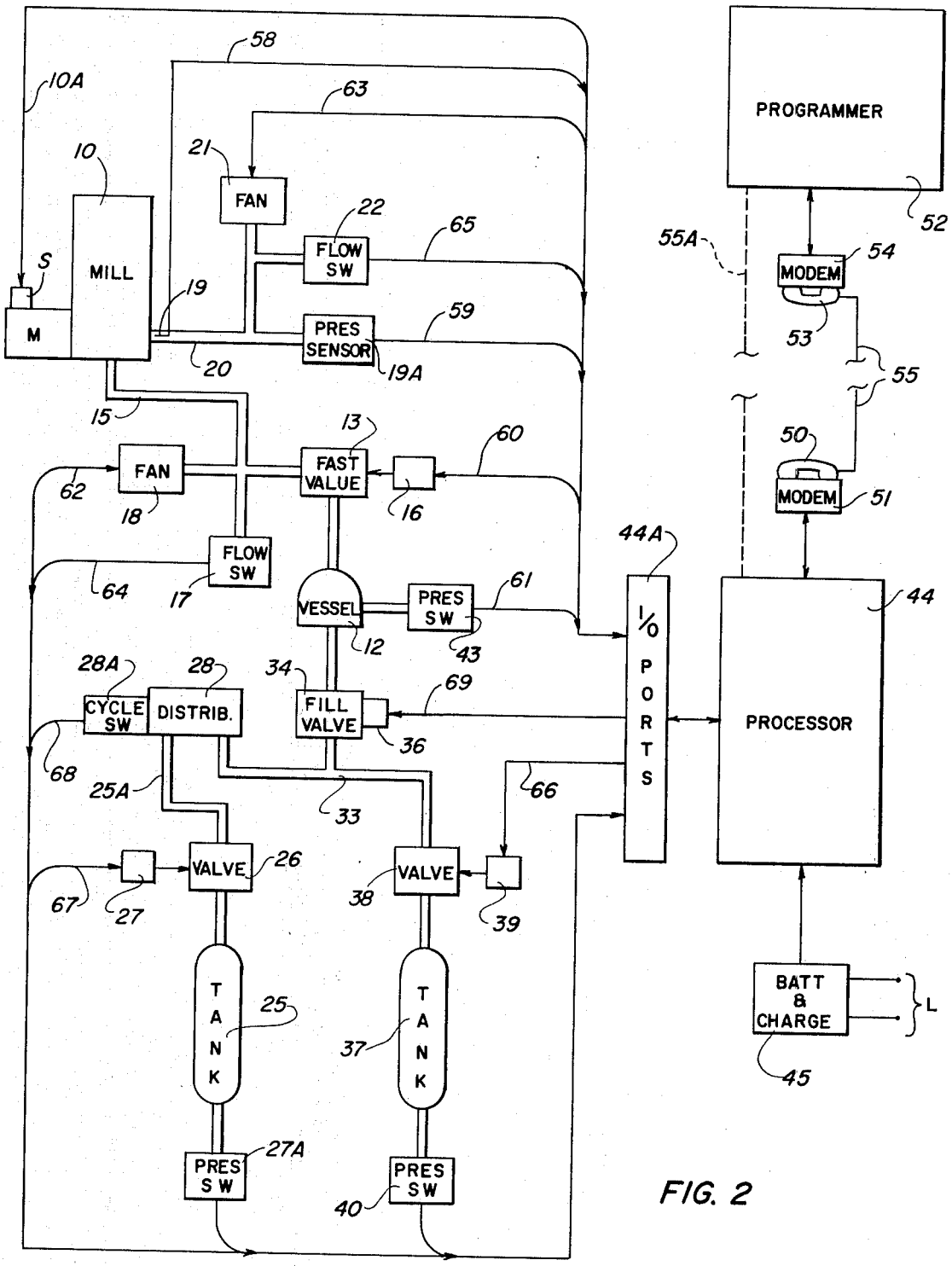
FIG. 2 is a schematic block diagram of the elements, components, and controls for the system of FIG. 1.

As seen in FIGS. 1 and 2, the present system is provided with a source of fire suppression agent held in tank 25 and connected through a control valve 26 to a metering device 28, which can be a Trabon Manifold type distributor. Control valve 26 is operated by motor means 27. The metering device 28 is provided with a quantity cycling switch 28A which will signal when the correct amount of agent has been delivered. The metering device may be of the type disclosed in Trabon Engineering Corporation's Robson U.S. Pat. No. 3,074,509 issued Jan. 22, 1963 which operates to deliver agent in proper proportions or quantities to several stations. In the present case, the delivery of the agent is made to the several units 11. More specifically, the metering device 28, under control of the cycling switch 28A is able to furnish a supply of agent through conduit 30 to a supply control valve 31 for the unit 11 at the right side of the shredder 10. The supply valve 31 is operated by motor means 32 and delivers the agent to the vessel 12 which at the time of delivery has its high speed valve 13 closed. A measured quantity of agent is thus supplied to the vessel 12 at normal pressure. Similarly, the left hand unit 11 is supplied with agent from the metering device 28 through conduit 33 and valve 34. The valve 34 is connected to the vessel 12 by conduit 35, and motor means 36 opens and closes the valve. Vessels 12 may not have the same capacity.

After desired quantities of agent have been delivered to the respective vessels 12 the metering device 28 is stopped and the vessels are pressurized by the nitrogen, delivered from storage tank source 37 through valve 38 operated by motor means 39. The pressure condition of the source 37 is monitored by pressure sensing means 40 which signals when the source 37 needs to be replenished. When pressurization of the vessels 12 is required, they are treated one at a time. Starting, for example, with the left hand vessel 12, when valve 38 is opened to conduit 33, valve 41 is closed by operation of its motor means 42, thus forcing the nitrogen to flow through open valve 34 to the associated vessel 12. The nitrogen is stored at source 37 at a high pressure so that when about 350 pounds pressure is reached in vessel 12 a pressure sensor 43 will generate a signal to close valve 34 and open valve 41 so the nitrogen will flow through conduit 30 to the now open valve 31 to replenish the right hand vessel 12. At the predetermined pressure of about 350 pounds per square inch sensed by a pressure sensing means 43, the valve 38 at the nitrogen source 37 is closed.

Each high speed valve 13 can be tested for complete closure after an explosion by first releasing nitrogen, which is relatively inexpensive when compared with bromochloromethane, into the vessels 12 by opening valves 31 and 34 sequentially, and opening valves 38 and 41 in the proper order so nitrogen can pressurize the vessels 12 up to approximately 10 pounds, or some suitable pressure level, which will show that the valves 13 are closed. This testing is carried out one at a time so a defective valve 13 can be found. Also, the conduits connecting the metering device 28 to the respective vessels 12 need to be as short as possible so that very little of the agent resides in the conduits. Normally the agent in the conduits 30 and 33 can be moved into the vessels 12 when the nitrogen agent is delivered to bring the vessels 12 up to operating pressure.

As indicated in FIGS. 1 and 2, the system includes processor means 44 to which signal transmitting lines are connected through Input/Output port 44A (hereafter I/O port). This port 44A provides suitable connections for the functional elements such as flow switches, pressure detectors, pressure switches, fans, and valves. The means 44 is provided with electrical power input lines L to a power supply 45 which includes a standby battery supply connected to an AC charger (not shown) so that the means 44 may operate at all times on AC with battery standby, and the charger will keep the battery charged up. The power supply 45 is arranged so that a low level current will be available to test the continuity of all electrical leads without actually operating the motor means. The processor means 44 embodies a central processing unit 45 connected through a buss 46 to memory 47, recorder 48, programmable timer 49, interrupt logic 50, program counter 51, data counter 52, memory addressing logic 53, and duplicate memory and addressing logic 54 for direct access to memory 47. The means 46 is important in that it is set to operate electronically so that all of the functioning elements, devices and means of the system are coordinated in a program. A unique feature of the present embodiment is that after a fire or an explosion suppression cycle has occurred, the operator of the mill 10 can telephone a central office of the manufacturer of the explosion suppression system, report the event that the system has reacted to suppress an explosion. As is shown in FIG. 2 the telephone instrument 50 and a modem 51 connected to the processor means 44 can be connected to a programmer 52 by a second telephone instrument 53 and modem 54 by transmission line 55.

By telephone modem connection the programmer 52 could run through the program circuits in the means 44 to do the following things:

a. reclose all high speed valves 13 by de-operating motor means 16.
b. turn on all blowers 18 and 21 to prove through the sensor means 17 and 22 that the conduits 15 and 20 are not clogged or obstructed with material from the inside of the mill 10.
c. apply a low current through the several electrical leads to make sure the electrical systems are intact, and test all systems to be certain there is no grounded circuit.
d. test valves 13 for effective closure as described above.
e. open the valve 26 at the source 25 of the agent, operate the distributor 28 and its cycle switch 28A to supply agent to each of the vessels 12, in turn, until the necessary quantity of agent is loaded into the vessels 12. This operation will necessitate operation of valve 41 by its motor means 42.
f. monitor the cycle switch 28A so that the quantity of agent supplied to each vessel 12 can be determined.
g. close the source 25 of agent and open the valve 38 at the source of pressurizing nitrogen 37 to pressurize each vessel 12 until the pressure sensors 43 signal attainment of the desired pressure.
h. perform all of the foregoing steps and signal the operating personnel at the mill 10 that the safety devices are operational.
i. Following the event of a signal going to the unit 44 sensing a flame front at means 19 or an explosion condition by pressure rise sensed at means 19A, the unit 44 would perform its function to reapply power to the mill driving motor M so it could be started after steps a through h have been taken.

In addition to the reloading sequence the control system is designed to do the following:

a. keep track of the operating time of the mill 10 by the clock timer so that at about 100 hours of operating time the system could be required to be checked out by means of the telephone modem.
b. read the pressure devices 27A and 40 to determine that a suitable quantity of agent in source 25 and nitrogen in source 37 is available, and to adjust it as nitrogen may be absorbed into the agent or to make adjustments in the pressure based on ambient temperature.
c. place in a memory the time and duration of any explosion or fire so that at a later date this memory area can be polled to possibly determine the type and character of explosion and its subsequent pressure buildup.
d. constantly poll all external circuits to keep a record in memory the cause and time of any system shut down.
e. internally poll all circuits and keep track of any soft errors that corrected themselves so that each 100 hours check the elements can be found and replaced.

Figure 3:
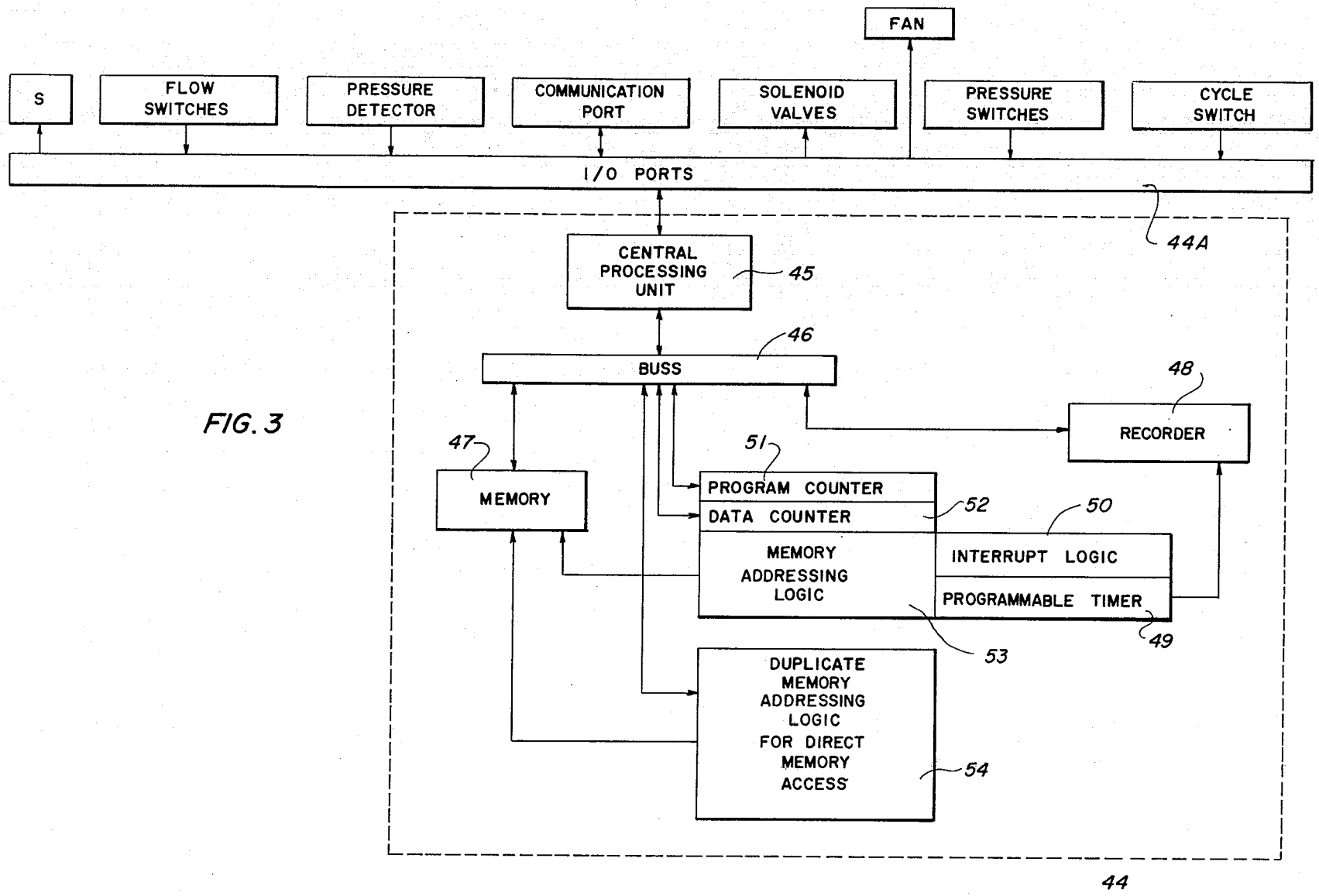
FIG. 3 is a block diagram of the components embodied in the processor.

An illustration of the remote control and monitoring provisions to be applied is shown schematically in FIG. 2, and further details are shown in FIG. 3 to which reference will be made where appropriate. It is to be understood that the processor means 44 embodies the necessary circuits for performing the steps outlined above in monitoring the elements associated with the shredder 10 which react when the infrared sensor 19 responds to the presence of a flame or the pressure rise sensor switch 19A responds to a significant rise in the pressure within the enclosure represented by the shredder mill 10. The circuit connections between the processor means 44 and the several devices seen in FIG. 1 making up the unique system are brought in through the I/O port. The infrared sensor 19 is connected into the I/O port 44A by lead 58 and the pressure sensor switch 19A is connected by lead 59. The sensors respond to impending problems within the mill 10 and send signals into the processor 44 which in turn, sends signals to offset the problem by operating the valve 13 through its solenoid motor means 16 to release the suppressing agent in the pressurized vessels 12 to the mill interior. The valve motor 16 is connected into the I/O port 44A by lead 60, and the fact of the discharge of the agent from the vessel 12 is monitored by its pressure switch 43 which transmits a signal by lead 61 into the I/O port 44 which activate a recorder 48 and timer unit 49 which memorizes the time and duration of the event. Simultaneously with the release of some or all of the agent by valve 13, the processor 44 opens the power supply to motor M connected by lead 10A through its starting element S.

After the system has functioned to suppress a flame and stopped the ensuing explosion it is necessary for the mill operator to either sequence the processor 44 through its steps for restoring the system to operative conditions, which can be done if the programmer 52 is locally connected through leads 55A, or to telephone by phone 50 to the remote central office phone 53 and report the shut down of the mill. The operator at the central office will then instruct the mill operator to combine the phone unit 50 with the local modem 51 and the remote operator will combine his telephone unit 53 with the remote modem 54 to connect up with the modem 51 through telephone line 55. The operator at the central office can then utilize the programmer 52 to instruct the various circuits in the processor 44 to step by step be sure the high speed valve or valves 13 are closed, and turn on blowers 18 and 21 by leads 62 and 63 to test the conduits 15 and 20 for obstruction by monitoring the response signals from the respective flow switches 17 and 22 through the associated leads 64 and 65. Furthermore, the processor 44 can be instructed to apply a low level current through the electrical systems associated with the mill to make sure there is no broken or grounded circuit. In addition the source of nitrogen medium 37 can be opened at valve 38 by its lead 66 to test the fact of the closure of high speed valves 13 by filling vessels 12 until pressure responsive switches 43 signals through lead 61 that pressure has built up on the vessel. This program of events is continued on to recharge vessels 12 with the bromochloromethane agent from source 25 by opening valve 26 through its motor means 27 connected by lead 67, and by activating the cycle switch or element 28A at the metering device 28 by its lead 68.

The view of FIG. 2 is simplified to show only one vessel 12, but it is understood that two or more vessels 12 can be incorporated in the system to function as described in FIG. 1. While the agent from source 25 is recharging the vessel 12 the source of medium 37 is shut off to allow the element 28A to measure the quantity of agent delivered to vessel 12. When recharging vessel 12 is completed, the valve 26 is closed by a signal through lead 67 to its motor 27 and valve 38 is opened to use the medium to pressurize the vessel 12 up to the desired level monitored by pressure switch 43. The flow of either agent or medium to vessel 12 is under the control of fill valve 34 through its circuit lead 69 to I/O port 44A.

The programmer 52 may be the type disclosed in Allen-Bradley Company Bulletin 1772, 5th Edition of Apr. 6, 1978, or associated Bulletins, embodying digital, electronic, solidstate systems. The programmer 52 is connected, as indicated, to the processor means 44 which reads input signals and generates output commands by interpreting instructions from the programs stored in a memory 47 (FIG. 3). There is also the I/O port 44A forming the interface with the external devices to be controlled and monitored. This I/O port 44A receives information in the form of electric signals from the components in the system of FIG. 2, and it also transmits action signals to those components. The programmer 52 contains the programming, editing and monitoring components of the complete system. The programmer 52 includes a keyboard (not shown) through which instructions are entered into the memory 47 through unit 45. Processor 44 functions in association with the foregoing programmer 52 to examine one instruction at a time, and to execute the necessary instruction before advancing to examine and carry out the next instruction. The instructions to be carried out through cooperation of programmer 52, the processor 44 and the external devices of FIGS. 1 and 2 through the interface I/O ports 44A have been set out above. Among the desired instructions are those in which the system of FIGS. 1 and 2 can be monitored at stated time intervals, say 100 hours of operating time of mill 10, to determine if components of importance are still functional and if there are any soft errors in the system. It is also important to know if the tanks 25 and 37 are sufficiently charged to guard against loss of suppression agent and nitrogen.

The advantage to be gained by the foregoing system in that expensive mill or shredder equipment can be protected from fire and explosion capable of being suppressed by the bromochloromethane agent if timely released into the enclosure. In addition the protective system can be constantly monitored by its processor 44 for a number of variables, and the down time of the system can be greatly reduced by use of the remote central office programmer.

The foregoing description is directed to an operating machine, such as a trash shredder, having a closed space in which fire and explosion may occur. The machine is intended to be protected by a system which senses conditions preceeding an explosion for the purpose of stopping the drive of the machine and releasing a pressurized suppression agent into the closed space at a time when possible destructive forces can be checked. The system includes a normally closed valve in the connection between the suppression agent container and the closed space for withholding the agent until it is needed to protect the operating machine, together with means for testing the communication of the sensing means with the closed space for obstructions as well as testing the communication between the sensing means and the closed space. The foregoing arrangement for protecting an operating machine is operatively connected into a processor 44 as indicated. The processor means 44 is on the premises where the machine to be protected is located, while the programmer 52 may be remotely located. If the distance is great the convenience of telephone modem means can be employed for sequentially examining the circuit connections to determine the existing operative conditions of the various means provided for protecting the operating machine.

The invention contemplates the use of the same size or capacity pressure vessels 12 so that the metering device 28 and cycling switch 28A can be eliminated. The system would then operate by using the nitrogen at pressure to test closure of the valves 13, followed by charging the vessels 12 with the agent directly fram tank 25 and monitoring the charging by sensing the rise in pressure by the pressure sensors 43 to cut off charging at 350 psi, or some desired pressure. The sensors 43 can be continually monitored through the processor means 44 to take into account the drop in pressure due to nitrogen dissolving into the agent or change in pressure due to ambient temperature changes. For too great pressure the vessels 12 can be bled-off and for a drop in pressure more nitrogen can be admitted, it being assumed that the initial charge of agent will not change. The foregoing can be implemented by the programmer 52 and the processor 44.

Figure 4:
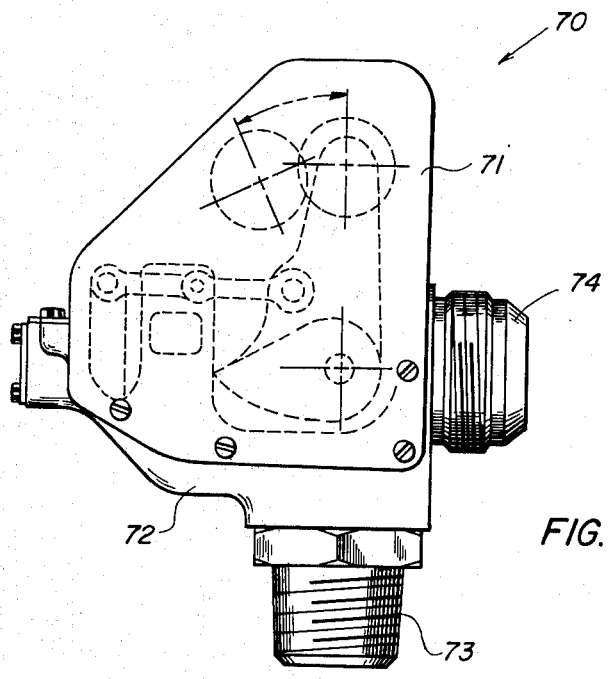
FIG. 4 is an elevational view of a high speed valve suitable for use in the system of FIGS. 1 and 2.
Figure 5:
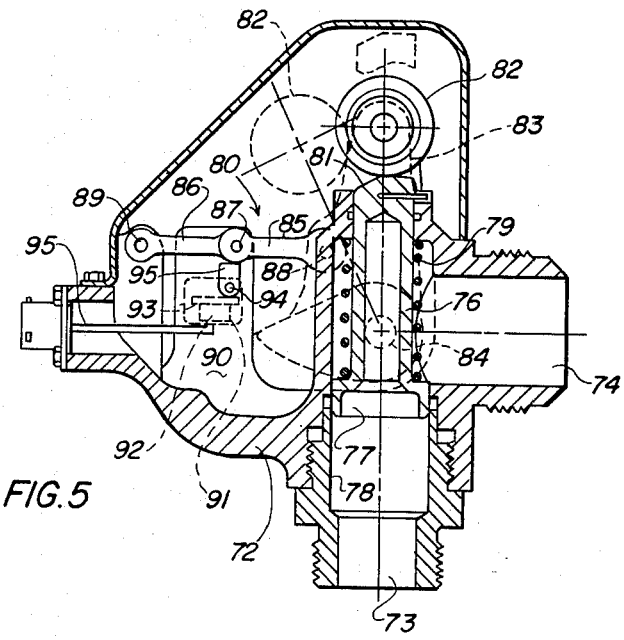
FIG. 5 is a sectional elevational view of the valve of FIG. 4 showing the manner of its operation in order to open communication between the inlet and outlet.

Turning now to FIGS. 4 and 5, there is shown an alternate high speed valve which may be employed in the place of the valve 13 previously described. The alternate valve is shown at 70 and includes a removable cover 71 attached to the valve body 72 which is formed with an inlet connection 73 and an outlet connection 74. As shown in FIG. 5 the communication between the inlet and outlet is normally blocked by a valve element 76 having its head 77 in sliding engagement in the cylindrical passage 78. The valve 76 is held in its cut off position by a spring 79, and by a hold down toggle mechanism 80. It is noted that the outer end of the valve 76 is formed with a cam surface 81 which is engaged by a roller 82 carried on and between the arms of a yoke, one arm being shown at 83 which has its pivot at 84. The yoke arm 83 is held in its operative position for preventing valve opening movement by a pair of links 85 and 86 which have adjacent ends connected by a pivot 87. The link 85 is pivotally connected at 88 to the yoke arm 83, and the link 86 has its end pivotally connected at 89 to a part of the valve body which is stationary. When the links 85 and 86 are positioned with the common pivot 87 lined up between the pivots 88 and 89, the yoke roller 82 is held in contact over the valve 76 and constitutes the primary means for holding the valve in its closed position.

When the links 85 and 86 move out of alignment so that the common pivot 87 raises above its normal position the yoke roller 82 is pulled off of its locking position onto the cam surface 81, and this movement combined with the pressure existing in the inlet 73 will rapidly force the yoke mechanism to one side as seen in broken outline which represents the valve open position. In order to elevate the common pivot 87 between the toggle links 85 and 86 there is provided in the portion 90 of the valve body 72 a chamber 91 for receiving an explosive squib 92. The squib force is transmitted to a plunger 93 which has an arm 94 projecting out of the chamber at a place where a pusher element 95 can engage the links at the pivot 87 and elevate the pivot to start the valve opening operation. The squib 92 is electrically detonated by a suitable connection 92 which receives its detonating signal through the processor in a manner similar to that which is shown in FIGS. 1 and 2 where the actuating signal lead 60 in FIG. 2 is connected through the motor means 16 for opening the valve 13. Once the valve 70 has been triggered, it is necessary to remove the cover 71 and reset the yoke roller 82 over the cam surface 81 of the valve 76 and to insert a fresh squib 91. The yoke roller 82 is of course held in its valve closure position by manually returning the toggle links 85 and 86 to the straight line position. It can be appreciated now that the alternate valve assembly 70 as shown in FIGS. 4 and 5 may be employed in place of the valve 13 illustrated in FIG. 1. In the case of either valve, it has a normally closed position for preventing passage of the fire and explosion suppression agent into the mill housing 10 until the need for the release of such suppression agent arises.

The invention is directed to a unique method of examining the functionality of plurality of protecting agencies associated with a closed space or with an operating machine having an enclosed space in which fire or a destructive force may occur by reason of a flame front generating a pressure condition within the closed space. This unique method embodies means adjacent the closed space for continuously monitoring for the presence of a flame or the pressure condition, sensing the presence of a flame or an abnormal pressure rise, rapidly releasing a pressurized suppression agent into the closed space to arrest the flame front and its resulting pressure increase, recording the time and duration of the event of the release of the agent in a remotely located processor unit, and submitting the processor to a remote preprogrammed unit for operative conditions respecting the functionality of the plurality of agencies, a periodic timer for maintenance checks, or following the event of the release of some or all of the suppression agent.

What is claimed is:

1. A fire and explosion suppression system for protecting an enclosure against destructive forces comprising: sensor means for sensing the initiation of a condition in the enclosure which if unchecked can cause destruction to the enclosure; a container for a fire and explosion suppression agent; a connection between said container and the enclosure including a valve normally closed and operable to release the entire charge of the agent in said container into the enclosure; processor means interconnecting said sensor means and said normally closed valve for opening said valve upon said sensor means sensing a condition associated with the advent of destructive forces that can cause destruction to the enclosure, the opening of said normally closed valve releasing the entire charge of agent to the enclosure through said connection; a source of suppression agent; means connecting said source of suppression agent to said container; a source of pressurizing medium; means connecting said source of pressurizing medium to said container for pressurizing said agent therein; operating connections between said sources of agent and medium and said processor means for effecting selectively the initial charging and the recharging of agent into said container and admitting medium for repressurizing the agent therein; and means for examining said processor means for determining the functional condition of the system.

2. The system set forth in claim 1 wherein, said sensing means is an element to respond to the presence of a flame front in said closed space.

3. The system set forth in claim 1 wherein, said sensing means is an element to respond to the pressure rise in said closed space preceeding an explosion.

4. The system set forth in claim 1 wherein, said sensing means includes both a flame front sensing element and a pressure rise sensing element.

5. The system set forth in claim 1 wherein, said sensing means is an infrared element to respond to flame conditions in said closed space.

6. The system set forth in claim 1 and including means to force air flow in said connection, and flow responsive means sensitive to the flow condition from said air flow forcing means.

7. In a fire and explosion protective system for space in which fire and explosion may occur, the combination of means for protecting the space by sensing a fire and the pressure rise conditions preceding an explosion comprising: sensing means communicating with said closed space for responding to a condition preceding an explosion; a container holding a pressurized fire suppression agent connected to said closed space; a source of agent communication with said container; a normally self-closing valve in said container connection for withholding the pressurized suppression agent; processor means having connections with said sensing means, said pressurized agent container, and said normally self-closing valve; programmer means operative for sequentially examining said processing means; and means interconnecting said programmer and said processing means for permitting said programmer to sequentially examine said processing means for determining the current condition in the system and for effecting a recharge of said container with suppression agent from said source of agent following complete discharge of said container holding pressurized agent.

8. The system set forth in claim 7 wherein, said sensing means is an element to respond to the presence of a flame front in said closed space.

9. The system set forth in claim 7 wherein, said sensing means is an element to respond to the pressure rise in said closed space preceeding an explosion.

10. The system set forth in claim 7 wherein, said sensing means includes both a flame front sensing element and a pressure rise sensing element.

11. The system set forth in claim 7 wherein, said sensing means is an infrared element to respond to flame conditions in said closed space.

12. The system set forth in claim 7 wherein testing means are connected into said communication between said sensing means and said container and said closed space for obstruction.

13. The system set forth in claim 12 wherein, said testing means includes means to force air flow in said communication and flow responsive means sensitive to the flow condition from said air flow forcing means.

14. The system set forth in claim 7 wherein, there is an agent measuring means for measuring the quantity of agent delivered to said agent container, valved means connecting said source of suppression agent with said agent container, means to monitor the quantity of suppression agent in said source thereof, and individual control connections between said central processing means and said agent measuring means, valved means and monitor means.

15. The system set forth in claim 7 wherein, there is recorder and timer means embodied in said processor means for recording the time and duration of opening of said self-closing valve.

16. A method of examining the functionality of a plurality of agencies associated with a protection system for a closed space in which fire and the pressure rise associated with an explosion may occur by reason of a flame front raising the pressure within the closed space, said method comprising: continuously monitoring the closed space for the existence of a destructive condition; sensing the conditions in the closed space; completely releasing to the closed space a pressurized suppression agent at high speed to effect the protection of the closed space; recording the event of the release of the suppresion agent in a processor having circuit connections with the plurality of agencies; located at a distance from the processor to monitor the events recorded in the processor; and operating the processor to respond to an examination of its recorded events, to effect a system check and to recharge the pressurized suppression agent and restore the functionality of the plurality of the agencies following a release of the suppression agent.

17. A method of operating a flame and explosion suppressing system for an enclosed space subject to the generation of flame associated with the pressure rise preceding an explosion, said method comprising the steps of: continually sensing the enclosed space for flame and for a rise in pressure; providing a container charged with a flame suppression agent under pressure connected to the enclosed space; providing a source of suppression agent and a source of gas under pressure connected to the container charged with the suppression agent; feeding signals drived from the sensing of the presence of a flame or the pressure rise into an electronic microprocessor for completely releasing the flame suppression agent from the container into the enclosed space; and feeding control signals from the microprocessor to the source of suppression agent and source of gas for effecting a recharging of the container with flame suppression agent pressurized by the gas under pressure following the release of the flame suppression agent.

18. The method set forth in claim 17 and comprising periodically monitoring the operability of the system through the electronic microprocessor.

19. The method set forth in claim 17 and comprising monitoring the operability of the system from a remotely disposed location through a programmer connection with the electronic microprocessor and for effecting the recharging of the container with flame suppression agent.

* * * * *